US009303954B2

(12) United States Patent
Lim

(10) Patent No.: US 9,303,954 B2
(45) Date of Patent: Apr. 5, 2016

(54) FIREARM SIMULATION SYSTEM SIMULATING LEADING FIRE, LASER-EMITTING DEVICE, AND TARGET DETECTION DEVICE

(75) Inventor: Seung-Chan Lim, Seoul (KR)

(73) Assignee: Korea Elecom Co., Ltd., Seoul (KR)

( * ) Notice: Subject to any disclaimer, the term of this patent is extended or adjusted under 35 U.S.C. 154(b) by 472 days.

(21) Appl. No.: 13/638,232

(22) PCT Filed: Jan. 31, 2011

(86) PCT No.: PCT/KR2011/000648

§ 371 (c)(1),
(2), (4) Date: Dec. 6, 2012

(87) PCT Pub. No.: WO2011/122762

PCT Pub. Date: Oct. 6, 2011

(65) Prior Publication Data

US 2013/0130204 A1 May 23, 2013

(30) Foreign Application Priority Data

Mar. 29, 2010 (KR) ..... 10-2010-0027950

(51) Int. Cl.
*F41G 3/26* (2006.01)
*F41A 33/02* (2006.01)
*F41J 5/02* (2006.01)

(52) U.S. Cl.
CPC ..... *F41G 3/2622* (2013.01); *F41A 33/02* (2013.01); *F41G 3/265* (2013.01); *F41G 3/2655* (2013.01); *F41G 3/2666* (2013.01); *F41J 5/02* (2013.01)

(58) Field of Classification Search
CPC ..... F41G 3/26; F41G 3/2616; F41G 3/2605; F41G 3/2622; F41A 3/00; F41A 3/02; F41A 3/04; F41A 3/06
USPC ..... 434/11–27
See application file for complete search history.

(56) References Cited

U.S. PATENT DOCUMENTS

| | | | | |
|---|---|---|---|---|
| 4,787,291 | A | 11/1988 | Frohock | 89/41.22 |
| 5,281,142 | A * | 1/1994 | Zaenglein, Jr. | 434/19 |
| 6,283,756 | B1 | 9/2001 | Danckwerth | 434/11 |
| 8,303,308 | B2 * | 11/2012 | Lindero | 434/11 |

FOREIGN PATENT DOCUMENTS

| | | | |
|---|---|---|---|
| KR | 10-1992-0006525 | B1 | 6/1988 |
| KR | 10-2006-0069799 | A | 6/2006 |
| KR | 10-0920527 | B1 | 7/2007 |

OTHER PUBLICATIONS

International Search Report.

* cited by examiner

*Primary Examiner* — Timothy A Musselman
(74) *Attorney, Agent, or Firm* — Stein IP, LLC

(57) ABSTRACT

Provided is a firing weapon simulation system simulating leading firing. The firing weapon simulation system is configured to include laser firing apparatus mounted on a firing weapon and a target sensing apparatus attached to a target. The laser firing apparatus includes a first control unit, a firing switch which is driven cooperatively with firing of the firing weapon, an image processing unit which measuring a leading angle from an image including the moving target, a first GPS receiver, a laser beam firer, and a motor assembly which rotates the laser beam firer. When the firing switch is switched on, the first control unit generates the firing data, allows the motor assembly to reversely rotate the laser beam firer by a measured value of the leading angle, and allows the laser beam firer to emit the laser beam carrying the firing data. The target sensing apparatus includes a second control unit, a sensing circuit unit which extracts firing data from the laser beam, a second GPS receiver, and a hitting situation indicator which indicates hitting result according to a driving signal transmitted from the second control unit. The second control unit solves simultaneous equations of the trajectory equation of the firing weapon and the equation of motion of the target to determine whether or not the target is hit and outputs a result of the determination to the hitting situation indicator.

16 Claims, 8 Drawing Sheets

FIREARM SIMULATION SYSTEM SIMULATING LEADING FIRE, LASER-EMITTING DEVICE, AND TARGET DETECTION DEVICE

TECHNICAL FIELD

The present invention relates to a firing weapon simulation system used for a battle simulation system, and more particularly, to a firing weapon simulation system capable of simulating a leading angle using a laser beam and accurately training leading firing on an aerial target or a ground target which moves at a high speed.

BACKGROUND ART

As one of battle simulation systems, MILES (Multiple Integrated LASER Engagement System: 'MILES') is a laser-applied training system where firing weapons are allowed to emit a laser beam instead of bullets and sensors attached to targets are allowed to sense the laser beam emitted from the firing weapons, so that it is determined whether each target is hit. The MILES system is generally configured to include a firing weapon simulation system attached with a laser beam firer and sensors capable of sensing laser beams. The MILES system may further include a central control system which can communicate with the firing weapon simulation system and the sensors.

Operations of the MILES system having the configuration described above will be described in brief as follows. First, if a shooter operates the firing weapon simulation apparatus to emit a laser beam and the laser beam reach a target, a sensor attached to the target senses the laser beam. If the sensor senses the laser beam, it is determined that the target attached with the sensor is hit by the firing weapon simulation apparatus. The hit event is displayed on a display such as a warning lamp or a display panel, or it is transmitted to the central control system.

On the other hand, in the case where the speed of a moving target is high or the moving target is at a long distance, in the actual situations, leading firing needs to be performed by setting a leading angle according to the speed of the moving target and the speed of the flying bullet of the firing weapon. Herein, the leading angle denotes an angle corresponding to a moving distance of the target from the current position of the target to the future position of the target with respect to a center of the gun. Therefore, the shooter can accurately hit the target by performing firing by setting an accurate leading angle with respect to the current position of the moving target.

However, since the laser beam has straightness and is moved at the speed of light, the laser beam reaches the future position of the target before the moving target moves to the future position. Therefore, the MILES systems or the firing weapon simulation systems using the laser beam in the related art have a problem in that the leading firing cannot be accurately simulated.

DISCLOSURE

Technical Problem

The present invention is to provide a firing weapon simulation system configured to include a laser firing apparatus and a target sensing apparatus to accurately simulate leading firing.

The present invention is to provide a firing weapon simulation system capable of accurately simulating leading firing and accurately training the leading firing on a high-speed moving target by feeding an aiming error amount back to a laser firing apparatus.

Technical Solution

According to a first aspect of the present invention, there is provided is a laser firing apparatus mounted on a firing weapon to simulate leading firing with respect to a moving target by using a laser beam, including: a first control unit which controls whole operations of the laser firing apparatus; a firing switch which is driven cooperatively with firing of the firing weapon; an image processing unit which measuring a leading angle from an image including the moving target aimed with the leading angle set through a sighting scope of the firing weapon; a first GPS receiver which receives a current position coordinate: a laser beam firer which is mounted on the firing weapon to emit a laser beam carrying firing data according to a laser driving signal supplied from the first control unit; and a motor assembly which rotates the laser beam firer according to a motor driving signal supplied from the first control unit, wherein, when the firing switch is switched on, the first control unit generates the firing data, allows the motor assembly to reversely rotate the laser beam firer by a measured value of the leading angle, and allows the laser beam firer to emit the laser beam carrying the firing data.

In the laser firing apparatus according to the first aspect, the laser firing apparatus may further include an image capturing apparatus, wherein the image capturing apparatus captures the image including the moving target aimed with the leading angle set through the sighting scope of the firing weapon and supplies the captured image to the image processing unit, and wherein a center of a display screen of the image capturing apparatus is disposed to be coincident with a center of a crosshair of the sighting scope of the firing weapon.

In the laser firing apparatus according to the first aspect, the image processing unit may receive the image of the target aimed through the sighting scope from the sighting scope of the firing weapon.

In the laser firing apparatus according to the first aspect, the laser firing apparatus may further include a first radio signal transceiver which communicates data with a target sensing apparatus, wherein the first control unit receive hitting result information from the target sensing apparatus through the first radio signal transceiver and outputs the hitting result information through a display apparatus.

In the laser firing apparatus according to the first aspect, the image processing unit may detect a beacon signal from the image including the moving target, recognize the moving target by using the detected beacon signal, and measure the leading angle by using a distance between the recognized moving target and a center of the image.

In the laser firing apparatus according to the first aspect, the firing data may include the measured value of the leading angle input from the image processing unit, the current position coordinate input from the first GPS receiver; and firing weapon identification information read from a memory.

According to a second aspect of the present invention, there is provided is a target sensing apparatus mounted on a target for simulating leading firing by using a laser beam, including: a second control unit which controls whole operations of the target sensing apparatus; a sensing circuit unit which includes a plurality of laser sensors and extracts firing data from the laser beam received from the laser sensors; a second GPS receiver which is mounted on the target and receives a current position coordinate of the target; and a hitting situation indicator which indicates hitting result according to a driving signal transmitted from the second control unit, wherein the second control unit obtain a trajectory equation of each firing weapon from database, and if the firing data are received from the sensing circuit unit, the second control unit reads firing weapon identification information, a measured value of a leading angle, and a current position of the firing weapon from the firing data, reads a trajectory equation corresponding to the firing weapon identification information from the database, and sets a trajectory equation by inserting the measured value of the leading angle and the current position of the firing weapon into the read trajectory equation, and wherein the second control unit sets an equation of motion of the target by using a current position value of the target and a velocity of the target transmitted from the second GPS receiver, solves simultaneous equations of the trajectory equation and the equation of motion of the target to determine whether or not the target is hit, and outputs a result of the determination to the hitting situation indicator.

In the target sensing apparatus according to the second aspect, the sensing circuit unit may include a sensing unit which is configured to include a plurality of the laser sensors, an amplifier which amplifies signals transmitted from the sensing unit, and a decoder which decodes signals transmitted from the amplifier to extract the firing data.

In the target sensing apparatus according to the second aspect, the second control unit may determine whether or not a difference value between a bullet position obtained by using the trajectory equation and a target position obtained by using the equation of motion of the target is included within a predefined threshold range; and if the difference value is included within the threshold range, the second control unit may determine that the target is hit; and if the difference value is not decreased to be equal to or less than the threshold value, the second control unit may determine that the target is not hit.

In the target sensing apparatus according to the second aspect, the target sensing apparatus may further include a beacon signal output unit which outputs a beacon signal according to a predefined pattern.

In the target sensing apparatus according to the second aspect, the target sensing apparatus may further include a second radio signal transceiver which can communicate data with the laser firing apparatus; and the second control unit may generate hitting result information including hitting information, aiming error information, and firing weapon identification information according to a result of determination whether or not the target is hit and transmit the hitting result information through second radio signal transceiver to the laser firing apparatus.

According to a third aspect of the present invention, there is provided is a firing weapon simulation system simulating leading firing by using a laser firing apparatus mounted on a firing weapon and a target sensing apparatus attached to a moving target, wherein the laser firing apparatus includes: a first control unit which controls whole operations of the laser firing apparatus; a firing switch which is driven cooperatively with firing of the firing weapon; an image processing unit which measuring a leading angle from an image including the moving target aimed with the leading angle set through a sighting scope of the firing weapon; a first GPS receiver which receives a current position coordinate: a laser beam firer which is mounted on the firing weapon to emit a laser beam carrying firing data according to a laser driving signal supplied from the first control unit; and a motor assembly which rotates the laser beam firer according to a motor driving signal supplied from the first control unit, wherein, when the firing switch is switched on, the first control unit generates the firing data, allows the motor assembly to reversely rotate the laser beam firer by a measured value of the leading angle, and allows the laser beam firer to emit the laser beam carrying the firing data, wherein the target sensing apparatus includes: a second control unit which controls whole operations of the target sensing apparatus; a sensing circuit unit which includes a plurality of laser sensors and extracts firing data from the laser beam received from the laser sensors; a second GPS receiver which is mounted on the target and receives a current position coordinate of the target; and a hitting situation indicator which indicates hitting result according to a driving signal transmitted from the second control unit, wherein the second control unit obtain a trajectory equation of each firing weapon from database, and if the firing data are received from the sensing circuit unit, the second control unit reads firing weapon identification information, a measured value of a leading angle, and a current position of the firing weapon from the firing data, reads a trajectory equation corresponding to the firing weapon identification information from the database, and sets a trajectory equation by inserting the measured value of the leading angle and the current position of the firing weapon into the read trajectory equation, and wherein the second control unit sets an equation of motion of the target by using a current position value of the target and a velocity of the target transmitted from the second GPS receiver, solves simultaneous equations of the trajectory equation and the equation of motion of the target to determine whether or not the target is hit, and outputs a result of the determination to the hitting situation indicator.

Advantageous Effects

In a firing weapon simulation system according to the present invention, leading firing on a moving target can be accurately simulated by using a laser beam. As a result, the leading firing with a leading angle can be accurately trained by using the firing weapon simulation system according to the present invention. In addition, according to the present invention, after a shooter who receives leading firing training pulls the trigger, the shooter can check whether or not the target is hit; and in the case where the target is not hit, the shooter checks an aiming error so as to perform corrected firing.

BEST MODE

Hereinafter, a configuration and operations of a firing weapon simulation system capable of allowing leading firing training according to a preferred embodiment of the present invention will be described in detail with reference to the attached drawings.

Figure 1:
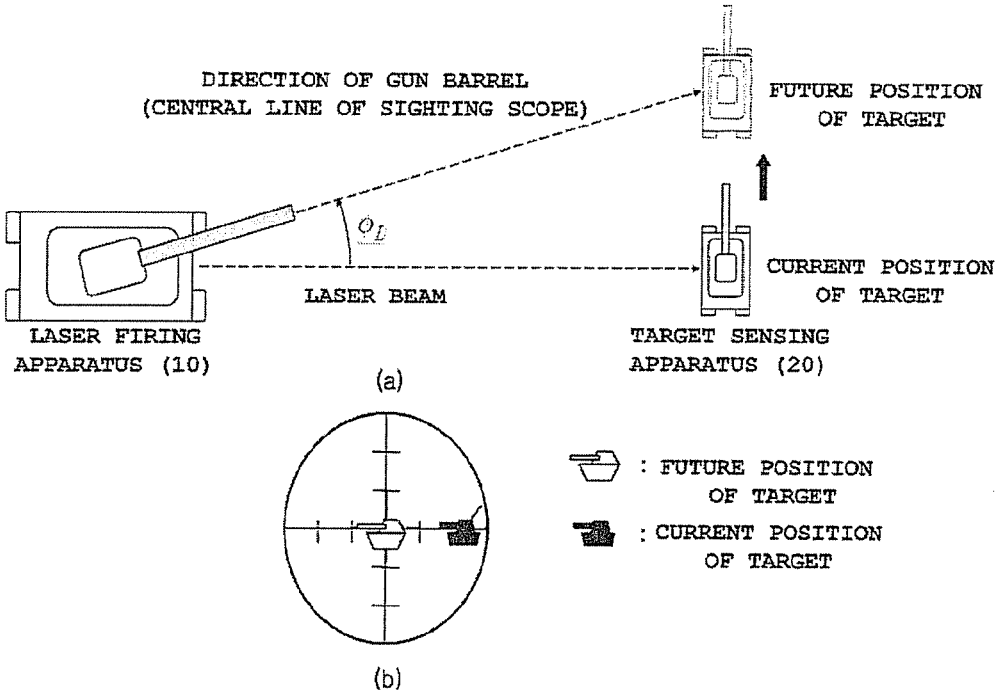
FIG. 1 is a diagram illustrating a concept and whole configuration of a firing weapon simulation system according to a preferred embodiment of the present invention.
Figure 2:
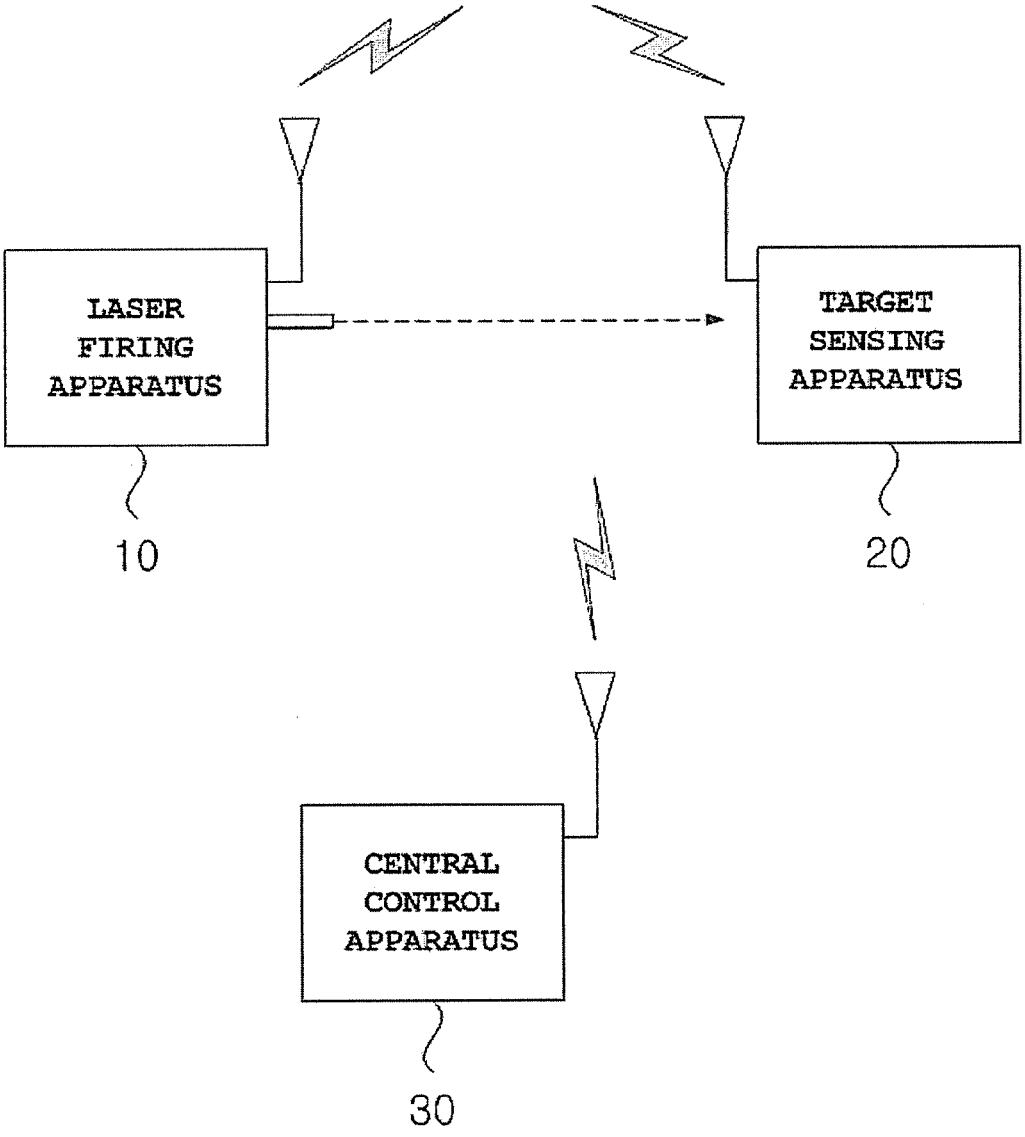
FIG. 2 is a block diagram illustrating the firing weapon simulation system according to the preferred embodiment of the present invention.

FIG. 1 is a diagram illustrating a concept and whole configuration of the firing weapon simulation system according to the preferred embodiment of the present invention. FIG. 2 is a block diagram illustrating the firing weapon simulation system according to the preferred embodiment of the present invention. Referring to (a) of FIG. 1, the firing weapon simulation system according to the present invention is configured to include a laser firing apparatus 10 mounted on a firing weapon and target sensing apparatuses 20 attached to targets. In (b) of FIG. 1, moving targets displayed on a sighting scope of the firing weapon, a center of the sighting scope, and leading angles are illustrated. Referring to (b) of FIG. 1, a leading angle can be obtained by using a current position of the moving target, a future position of the moving target, and a difference value between the current and future positions of the moving target. Referring to FIG. 2, the laser firing apparatus mounted on the firing weapon emits a laser beam, and the target sensing apparatus attached to the target senses the laser beam and extracts firing data from the laser beam. The laser firing apparatus and the target sensing apparatus communicates data including information of hitting result with each other in radio communication.

On the other hand, the firing weapon simulation system according to the present invention further includes a central control apparatus 30. The central control apparatus 30 communicates data with the laser firing apparatus and the target sensing apparatuses in a radio communication manner. The central control apparatus can control or monitor the driving of the laser firing apparatus and the target sensing apparatus by using data received from the laser firing apparatus and the target sensing apparatuses.

(Laser Firing Apparatus)

Figure 3:
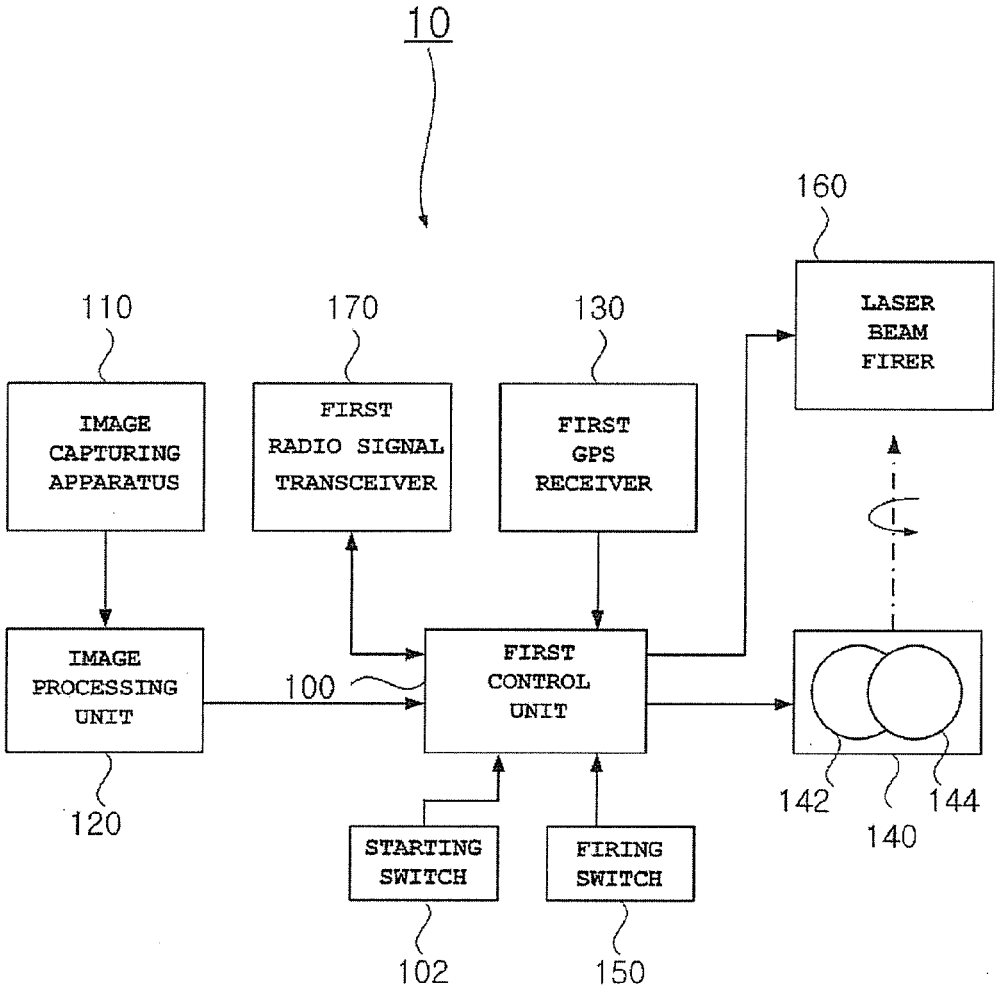
FIG. 3 is a schematic block diagram illustrating an internal configuration of a laser firing apparatus 10 of the firing weapon simulation system according to the preferred embodiment of the present invention.

FIG. 3 is a schematic block diagram illustrating an internal configuration of a laser firing apparatus 10 of the firing weapon simulation system according to the preferred embodiment of the present invention. Hereinafter, a structure and operations of the laser firing apparatus according to the present invention will be described in detail with reference to FIG. 3. The laser firing apparatus 10 includes a first control unit 100 which controls whole operations of the laser firing apparatus, a starting switch 102, an image capturing apparatus 110, an image processing unit 120, a first GPS receiver 130, a motor assembly 140, a firing switch 150, a laser beam firer 160, and a first radio signal transceiver 170. Hereinafter, structures and operations of the aforementioned components will be described in detail.

The first control unit 100 controls whole operations of the laser firing apparatus. The detailed operations will be described later.

If a shooter switches on the starting switch 102, the laser firing apparatus starts operations, and a firing sequence is started. Namely, the starting switch has a function of waking up processors and circuits of the laser firing apparatus which are in a standby or sleep mode for power saving. If the starting switch 102 is switched on, the first control unit 100 drives the laser firing apparatus.

The image capturing apparatus 110 may be configured with a video camera or the like. The image capturing apparatus 110 senses an image in a visible light range or an infrared light range and converts the image into electric signals. The image capturing apparatus 110 is arranged so that the center of the display screen is coincident with the center of crosshair of the sighting scope of the firing weapon. The image capturing apparatus 110 captures an image including the moving target and transmits the image to the image processing unit.

In the case where a visible-light video camera is used as the image capturing apparatus, there is an advantage in that information of various colors can be used to increase possibility of success in target recognition, but there is a disadvantage in that the use at night is limited. On the other hand, in the case where an infrared-light video camera is used as the image capturing apparatus, although it can be used at night, since the target recognition is performed through a monochromic screen, the possibility of success in target recognition may be decreased with respect to the same target in the same environment. Therefore, it can be determined according to the given situation and the firing weapon in use which one of the visible-light video camera and the infrared-light video camera is to be selected. For example, antitank direct fire weapons M72LAW, PZF-3, a 90 mm recoilless rifle, and the like which are used in Korean Amy have sighting scopes having no night indicating function. In the case where the above-described weapons are simulated, it is preferable that a visible-light video camera is attached to a firing apparatus.

In the laser firing apparatus according to another embodiment of the present invention, in the case where an image aimed through a sighting scope is provided as digital data, a separate image capturing apparatus may not be installed, and an image processing unit may receive an image captured by the sighting scope.

The image processing unit 120 receives the image from the image capturing apparatus and analyzes the image to identify the target and measure the leading angle with respect to the target. The image processing unit 120 supplies the leading angle to the first control unit 100. The image processing unit is configured to include a digital signal processor), a memory, a display apparatus, and the like.

At recent, due to rapid progress in hardware and software such as an increase in resolution of a camera sensor, improvement in a processing rate of CPU, an increase in capacity of a memory, and improvement in elaborateness of digital image processing algorithm, a technique of identifying a target through image analysis makes rapid progress. Particularly, in the case of a target of which noise of background image with respect to the target is not serious, for example, an aerial target with an air as a background or a ground target moving on the ground with a horizon as a background, the possibility of success in target recognition is very high.

In addition, fields of target recognition, identification, and tracking through image analysis have been greatly developed according to social demands for surveillance, security, and the like and rapid process in technical backgrounds. However, in the case where the background noise to the target signal is large, for example, in the case where a target is moving in smoke, fog, or mist, in the case where a target is camouflaged, or in the case where a target is in an outdoor situation such as a leave-falling situation, the problems of increasing possibility of target recognition and decreasing false alarm rate still remain to be solved. Particularly, in the firing weapon simulation system according to the present invention, in the case of using an infrared-light video camera, in order to increase the possibility of target recognition and to greatly decrease the false alarm rate, the firing weapon simulation system allows the target to emit an infrared beacon signal which blinks in a specific pattern and allows the image processing unit of the laser firing apparatus to analyze a sequence of image frames to extract the infrared beacon signal, so that accurate target recognition can be performed.

If the target recognition is completed, the image processing unit 120 measures the leading angle. The leading angle measuring process of the image processing unit is as follows. First, the center of the target is obtained; the distance (the number of pixels) between the center of the target and the center of the image is obtained; and the obtained distance is reduced into an angle, so that the leading angle is measured. At this time, since the reduced angle value varies with the zoom magnification ratio although the distance between two points of the image is the same, the leading angle is calculated by taking into consideration the zoom magnification ratio of the image capturing apparatus. The obtained value is a measured value of a leading angle. The leading angle is configured with a leading azimuthal angle and a leading elevation angle. The leading elevation angle includes an increment of the elevation angle which is increased by a shooter by taking into consideration a curve of a trajectory, that is, a super elevation angle. For example, in the case of simulating a situation where a tank moving on a hill is hit by a high-angle weapon using gravity, the measured leading azimuthal angle $\phi_L$ is an azimuthal angle component between the current position direction and the expected future position direction of the target; and the measured leading elevation angle $\theta_L$ is a sum of the elevation angle component between the current position direction and the expected future position direction of the target and the super elevation angle $\theta_{SE}$ set by the shooter. The image processing unit supplies the measured value of the leading angle to the first control unit 100.

The set leading angle may be changed after the shooter starts aiming of the firing weapon at the target just before the shooter pushes the firing switch. Therefore, the image processing unit repetitively performs the leading angle measurement process and transmits the measured value of the leading angle to the first control unit every time the measured value of the leading angle is updated.

The first GPS receiver 130 calculates the current position by using signals received from a plurality of GPS satellites and supplies the current position to the first control unit 100. The first GPS receiver 130 mounted on the firing weapon supplies the current position of the firing weapon to the first control unit. Among the position coordinate received through the first GPS receiver, latitude information and longitude information show accuracy of one meter or less in the case where a carrier of the receiver is in a stopped state, but evaluation shows low accuracy with an error of several tens or hundreds of meters. Therefore, in the embodiment, latitude information and longitude information are obtained from the position coordinate obtained through the GPS receiver, and accurate altitude information of a specific horizontal coordinate is obtained with reference to a digital map built in the target sensing apparatus. As a position receiver, instead of the GPS type receiver implemented by US, a Galileo type receiver implemented by EU or a receiver combining the GPS type and the Galileo type may be used.

On the other hand, a laser firing apparatus according to another embodiment of the present invention may not include the first GPS receiver, and the position coordinate may be received by using a GPS receiver which is separately carried by a shooter and wired or wireless communication unit.

The motor assembly 140 is driven according to a motor driving signal transmitted from the first control unit to rotate the laser firing apparatus. The motor assembly 140 is configured to include an azimuthal rotation motor 142 and an elevational rotation motor 144. The azimuthal rotation motor and the elevational rotation motor rotate the orientation of the laser firing apparatus by a measured value of a leading angle in the azimuthal angle and the elevation angle, respectively. In most firing weapons, since the leading angle needs to be precisely controlled in unit of mil (1 mil)=0.056°, it is preferable that the motor assembly includes a reduction gear.

The firing switch 150 is a switch which cooperates with a trigger of the firing weapon. Initially, the firing switch 150 is maintained to be in the OFF state. When the shooter pulls the trigger of the firing weapon, the firing switch 150 is in the ON state. When the shooter aims at the target through the sighting scope of the actual firing weapon and determines that the set leading angle is in a stabilized state, the shooter pulls the trigger of the actual firing weapon, and the firing switch is cooperatively switched on. If the firing switch is switched on, the first control unit converts the state value of the firing switch from OFF to ON. Accordingly, among the data carried on the laser beam which is repetitively emitted from the laser beam firer, the state value of the firing switch becomes ON, and the message is transmitted to the target sensing apparatus. If the state value of the firing switch is ON, the image processing unit stops the repetitive leading angle measurement process, and the first control unit generates the firing data of the time when the state value of the firing switch becomes ON and transmits the firing data to the target sensing apparatus and stop driving the laser firing apparatus. At this time, the firing data includes the firing weapon identification information, the measured value of the leading angle, the current position coordinate of the firing weapon, and the state value of the firing switch of the firing weapon. When the firing weapon is triggered, the state value of the firing switch of the firing data becomes ON.

The firing switch of the laser firing apparatus according to another embodiment of the present invention includes a vibration sensor, a bombing sound sensor, and the like which can sense a change of the firing weapon according to the firing. In the case where sensed signals received from the sensors exceed a predefined level, it is determined that the firing weapon is triggered, and the firing switch is changed into the ON state.

The laser beam firer according to another embodiment of the present invention may be embedded with a fine angle scanner in order to form a large beam width around the target. It is preferable that the first control unit of the laser firing apparatus embedded with the fine angle scanner stops operation after additionally driving the laser beam firer during one period of the fine angle scanning so that the message indicating the on state of the state value of the firing switch can be sufficiently notified to the target sensing apparatus.

The laser beam firer 160 emits the laser beam carrying the firing data according to the laser driving signal received from the first control unit 100. The firing data includes the firing weapon identification information, the measured value of the leading angle, the position coordinate of the firing weapon, and the state value of the firing switch. The firing weapon identification information indicates a type of a firing weapon attached with the laser firing apparatus. The measured value of the leading angle includes a measured value of a leading angle with respect to the azimuthal angle and a measured value of a leading angle with respect to the elevation. The position coordinate of the firing weapon include latitude information and elevation information with respect to the current position of the firing weapon. The state value of the firing switch indicates ON or OFF as a current state of the firing switch.

The laser beam needs to have a wide cross-section so that, although there is an error between the measured value of the leading angle and the motor driving angle, a link can be formed between the firing apparatus and the target sensing apparatus. As methods of forming a laser beam having a wide cross-section, there are a method of using a laser beam firer having wide beam divergence and a method of embedding a fine angle scanner in a laser beam firer. The laser beam firer having wide beam divergence is preferably used. However, since the laser beam firer emits high power beam, in the case of a long-range firing weapon, the power of the laser beam may exceed the range of eye-safety regulation.

In the case where there is a problem in the eye-safety, the latter method of embedding a fine angle scanner in a laser beam firer is used. The method may include a mechanical method using a motor for performing fine angle scanning and an electro-optic method. In an example of the electro-optic method, a prism is configured with a crystal showing an electro-optic effect. When a voltage is applied to the prism, a refractive index of the prism is changed, so that a propagation direction of the incident beam can be finely modified. A degree of a change in propagation direction can be adjusted according to a magnitude of the applied voltage.

The first radio signal transceiver 170 communicates data with the target sensing apparatus and the central control apparatus. The first radio signal transceiver receives data as to whether or not the target is hit, an aiming error amount, and the like from the target sensing apparatus. It is preferable that the first radio signal transceiver of the firing apparatus and the second radio signal transceiver of the target sensing apparatus locally directly communicate with each other without a relay. However, in the case where the number of trainees is not large and there is no problem due to communication load, the first radio signal transceiver of the firing apparatus and the second radio signal transceiver of the target sensing apparatus may be allowed to communicate with each other through a relay or a BS (base station).

Figure 4:
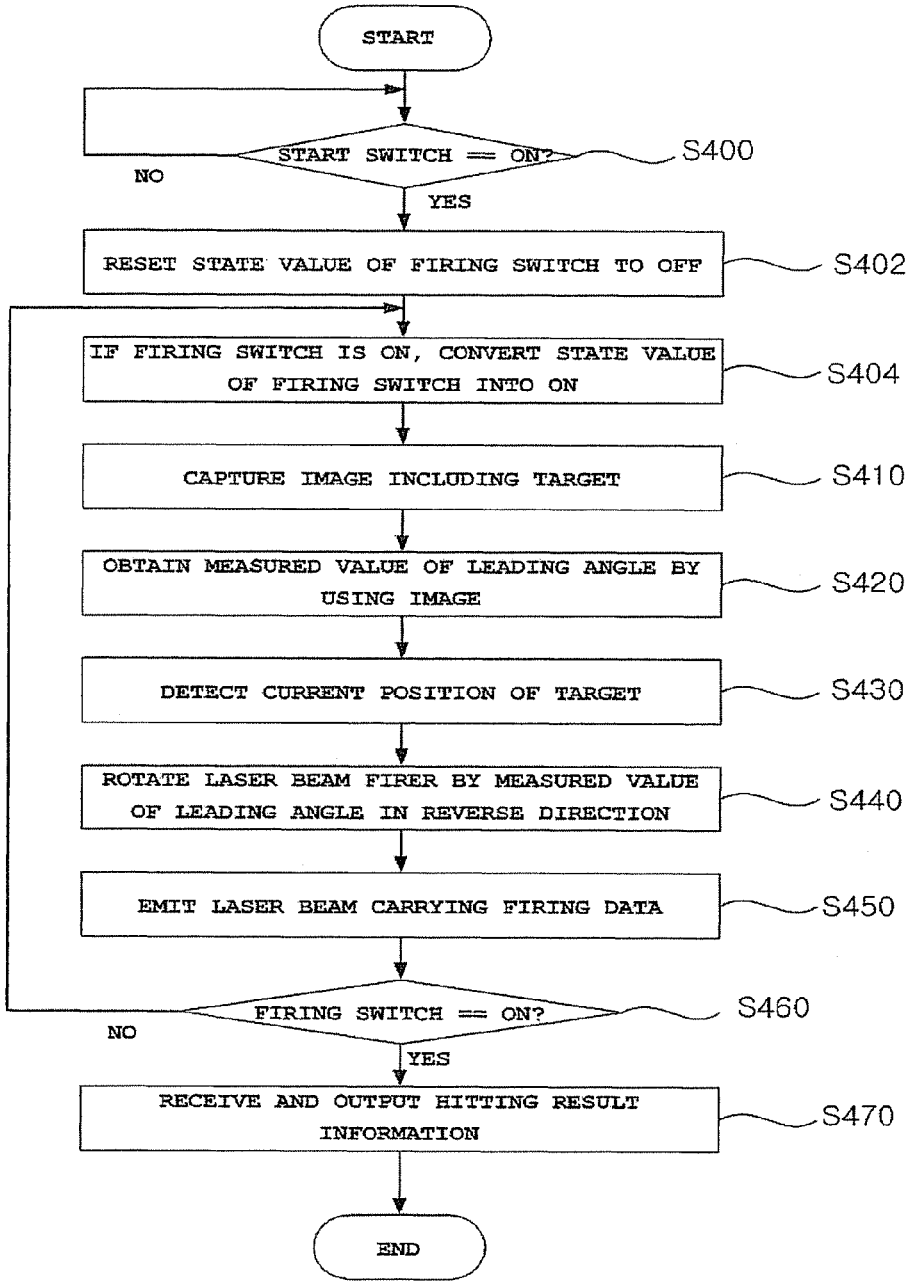
FIG. 4 is a flowchart for explaining a sequence of operations of a first control unit and an image processing unit of the laser firing apparatus of the firing weapon simulation system according to the preferred embodiment of the present invention.

FIG. 4 is a flowchart for explaining a sequence of operations of the first control unit and the image processing unit of the laser firing apparatus of the firing weapon simulation system according to the preferred embodiment of the present invention. Hereinafter, operations of the laser firing apparatus will be sequentially described with reference to FIG. 4. The first control unit 100 is configured to include a CPU, a memory, a display apparatus, a motor driving circuit, a laser driving circuit, an input/output interface, and the like.

First, the laser firing apparatus is mounted on the firing weapon. At this time, the center of the screen of the image capturing apparatus of the laser firing apparatus needs to be aligned so as to be coincident with the center of crosshair of the sighting scope of the firing weapon and the initial value of the beam firing direction of the laser beam firer. In this prepared state, when the starting switch is turned ON, the laser firing apparatus starts to be operated. The starting switch has a function of waking up processors and circuits of the firing apparatus which are in a waiting or slipping mode for power consumption. After the shooter observes the current position of the moving target through the sighting scope, the shooter adjusts the leading angle to orient the laser firing apparatus so that the center of crosshair of the sighting scope is coincident with the future position of the moving target corresponding to the leading angle.

After the shooter orients the laser firing apparatus toward the future position of the target, when the starting switch is turned ON (Step 400), the image capturing apparatus is driven to capture images of the target, and the captured images are supplied to the image processing unit (Step 410). The image processing unit analyzes the images supplied from the image capturing apparatus to obtain the measured value of the leading angle of the target and transmits the measured value of the leading angle to the first control unit (Step 420). Until the state value of the firing switch becomes ON, Steps 410 to 420 continue to be repeated.

When the first control unit receives the measured value of the leading angle from the image processing unit, the first control unit detects the current position of the firing weapon by using data received from the first GPS receiver (Step 430).

Next, the first control unit generates a motor driving signal for reversely rotating the orientation of the laser beam firer of the laser firing apparatus by the measured value of the leading angle and transmits the motor driving signal to the motor assembly (Step 440). The motor assembly is operated according to the motor driving signal supplied from the first control unit to rotate the laser beam firer. The laser beam firer is allowed to reversely rotate by the measured value of the leading angle, so that the laser beam firer is oriented toward the current position of the moving target.

In the state where the laser beam firer is oriented toward the current position of the moving target by the driving of the motor assembly, the first control unit drives the laser beam firer to emit the laser beam carrying the firing data (Step 450). At this time, the firing data includes the firing weapon identification information, the measured value of the leading angle, the current position of the firing weapon, and the state value of the firing switch. The initial value of the state value of the firing switch is set to OFF. Until the firing switch is turned ON, Steps 410 to 450 are repetitively performed.

After the shooter observes the current position of the moving target through the sighting scope and finally adjusts the leading angle to orient the laser firing apparatus so that the center of crosshair of the sighting scope is coincident with the future position of the moving target corresponding to the leading angle, the firing switch is turned ON by pulling the trigger. When the firing switch is turned ON by pulling the trigger, the first control unit changes the state value of the firing switch to be ON, and after that, Steps 410 to 450 are performed (Step 460).

Therefore, when the firing switch is turned ON, the laser beam carrying the firing data including the firing weapon identification information, the measured value of the leading angle, the current position of the firing weapon, and the state value of the firing switch indicating the ON state is emitted to the current position of the target.

Next, when the hitting result information is received from the target sensing apparatus through the first radio signal transceiver (Step 470), the first control unit analyzes the hitting result information. As a result of the analysis, in the case where the moving target is hit, it is noticed through display apparatus that the moving target is hit, and after that, the procedure is ended. As a result of the analysis, in the case where the moving target is not hit, an aiming error value is extracted from the hitting result information, the aiming error value is output to the display apparatus to be notified to the shooter, and after that, the procedure is ended. The shooter adjusts the leading angle again by using the aiming error value output to the display apparatus, so that the shooter can perform corrected firing.

(Target Sensing Apparatus)

Figure 5:
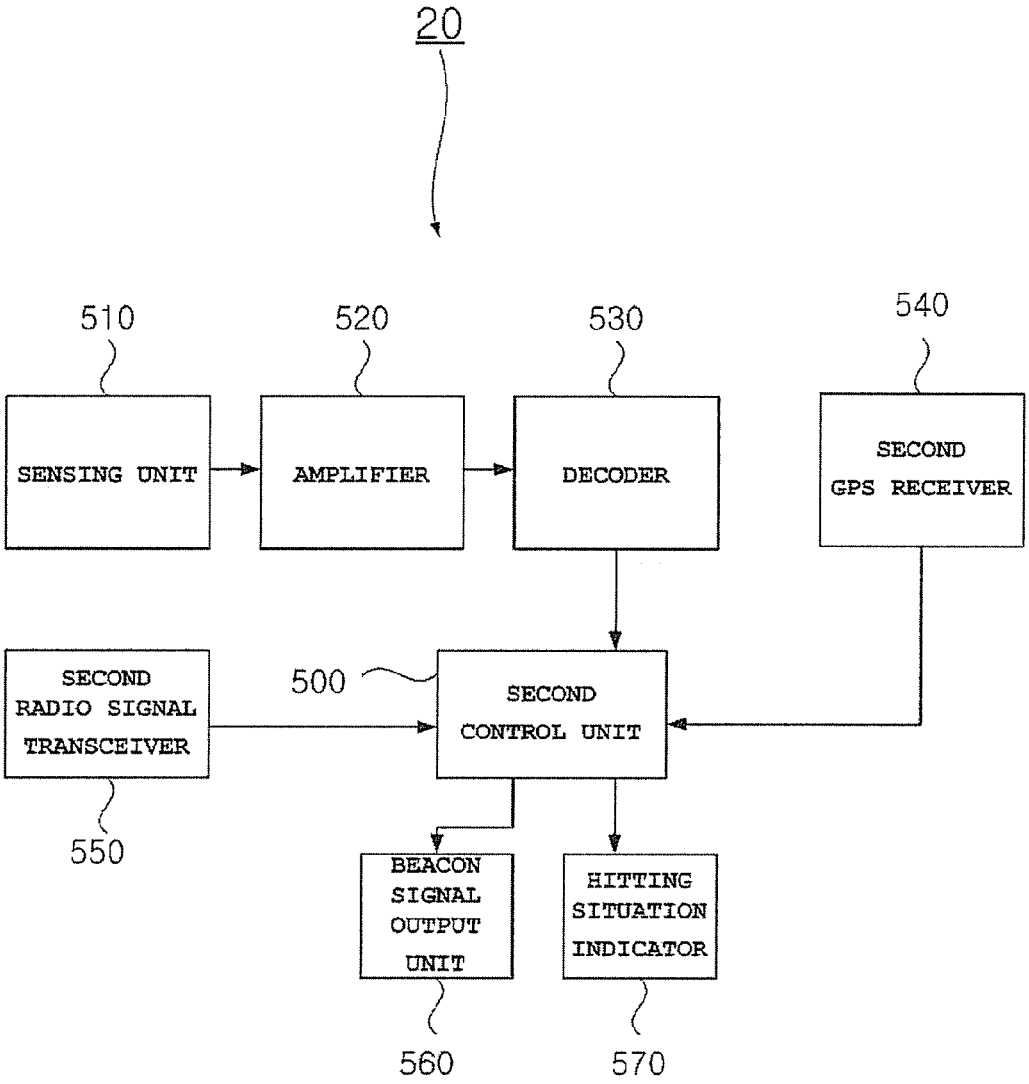
FIG. 5 is a schematic block diagram illustrating a configuration of a target sensing apparatus 20 of the firing weapon simulation system according to the preferred embodiment of the present invention.

FIG. 5 is a schematic block diagram illustrating a configuration of the target sensing apparatus 20 of the firing weapon simulation system according to the preferred embodiment of the present invention. Hereinafter, a structure and operations of the target sensing apparatus according to the present invention will be described in detail with reference to FIG. 5.

A target sensing apparatus 20 according to the present invention includes a second control unit 500 which controls whole operations of the target sensing apparatus, a sensing unit 510 which includes a plurality of laser sensors, an amplifier 520 which amplifies laser beam sensing signals transmitted from the sensing unit and outputs the laser beam sensing signals, a decoder 530 which decodes the laser beam sensing signals transmitted from the amplifier to extract firing information, a second GPS receiver 540 which detects a current position of a moving target, a second radio signal transceiver 550 which communicates data with the laser firing apparatus, a beacon signal output unit 560, and a hitting situation indicator 570.

The second control unit 500 controls the overall operations of the target sensing apparatus. The operations of the second control unit will be described later in detail.

The sensing unit 510 is configured in a form of a sensor belt so that a plurality of laser sensors is arranged at a constant interval. The sensing unit 510 senses the laser beam and transmits the laser beam to the amplifier. If the laser sensors sense the laser beam, the sensing unit 510 generates a current in proportion to an intensity of the laser beam. In the case where a wavelength of the laser beam is 904 or 905 nm, silicon PD (photo detector) chips are generally used as sensing devices, and the PD chips are covered with a filter in order to block noise with respect to visible light. In the case where a target is a tank or a vehicle, a sensor belt is attached to each of front, rear, left, and right sides of the target. The laser sensors arranged in each sensor belt are connected in parallel, so that the currents generated from the laser sensors are added to be applied to the amplifier.

The amplifier 520 amplifies a weak electric signal, which is generated in proportion to the intensity of the laser beam by the laser sensor, into a digital signal of which intensity is at a level enough to be processed by the decoder. In general, the input signal of the amplifier is current, and the output signal thereof is voltage. A gain of the amplifier is expressed by a ratio of an output voltage to an input current, and its unit is resistance. Therefore, the amplifier is called a TRA (transresistance amplifier).

In general, the amplifier performs a band pass filter function as well as an amplification function. For example, if a pulse width of the emitted laser beam is 300 nsec, values of parts of the filter is set so that a central frequency of the band pass filter is 1/300 nsec=3.3 MHz. Accordingly, the amplifier selectively amplifies only the pulse of about 300 nsec and remove the pulses having different time widths as noise, so that the signal-to-noise (S/N) ratio of the amplifier is improved. As a result, the laser sensing performance of the target sensing apparatus, that is, sensitivity can be improved. In the case where the amplifier also has the band pass filter function, the unit of the gain of the amplifier is not simply resistance, and thus, the amplifier is called a TIA (transimpedance amplifier).

The output voltage of the amplifier described above is converted into a digital level to be applied to the decoder.

The decoder 530 decodes the laser beam sensing signals to recover the firing data carried on the laser beam without error and transmits the firing data to the second control unit. The firing data include the firing weapon identification information, the measured value of the leading angle, the firing weapon position information, the state value of the firing switch, and the like.

The beacon signal output unit 560 emits a light beam which blinks in a predefined specific patter so that the image processing unit of the laser firing apparatus can easily identify the target. The image capturing apparatus of the laser firing apparatus irradiates an infrared light beam in a specific pattern.

The hitting situation indicator 570 is configured with a warning lamp, a speaker, or the like. The hitting situation indicator outputs a message indicating that hitting event occurs by blinking the warning lamp or driving the speaker of the hitting situation indicator according to a driving signal transmitted from the second control unit. Due to the driving of the hitting situation indicator, the message indicating that the hitting event occurs can be audio-visually notified to a shooter of a firing weapon, a trainee boarding on a tank or a vehicle as a moving target, an attendant trainee, or a supervisor.

The second GPS receiver 540 is attached to the target to detect current position information of the target by using signals received from a plurality of GPS satellites and transmits the current position information to the second control unit.

The second radio signal transceiver 550 communicates data with the laser firing apparatus in a wireless manner to transmit hitting result information such as information as to whether or not the target is hit and an aiming error amount to the laser firing apparatus under the control of the second control unit.

Figure 6:
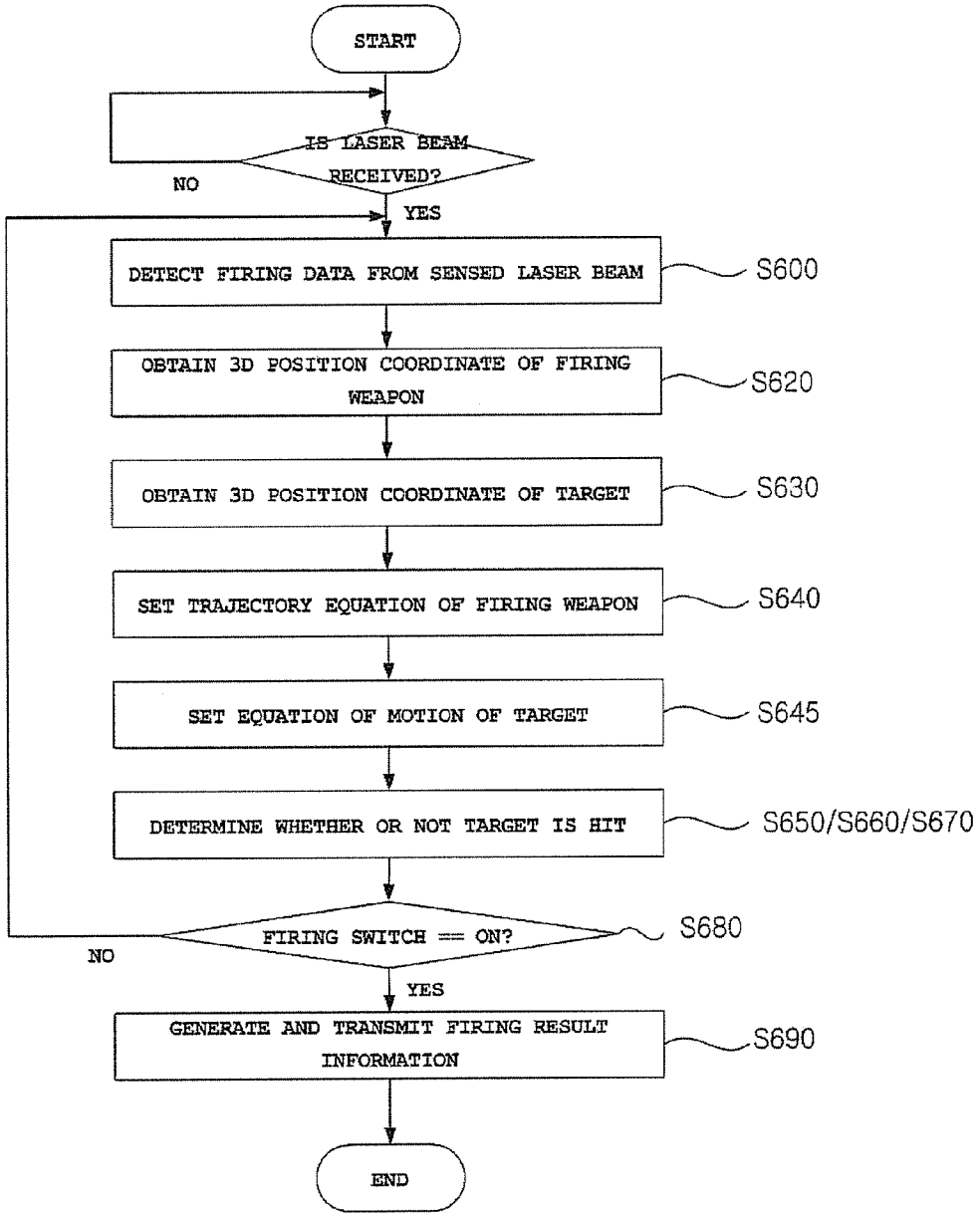
FIG. 6 is a flowchart for explaining a sequence of operations of a second control unit of the target sensing apparatus of the firing weapon simulation system according to the preferred embodiment of the present invention.

Hereinafter, operations of the second control unit of the target sensing apparatus according to the preferred embodiment of the present invention will be described in detail with reference to FIG. 6. FIG. 6 is a flowchart for explaining a sequence of operations of the second control unit of the target sensing apparatus of the firing weapon simulation system according to the preferred embodiment of the present invention.

Referring to FIG. 6, the second control unit receives the firing data recovered from the laser beam through the sensing unit, the amplifier, and the decoder (Step 600).

The second control unit extracts latitude information and longitude information of the current position coordinate of the firing weapon from the received firing data and retrieves a built-in digital map to extract altitude information of the current position coordinate (latitude, longitude) of the firing weapon, so that three-dimensional position coordinate $O(x_0, Y_0, z_0)$ of the firing weapon is obtained (Step 620). In the same manner, the second control unit extracts latitude information and longitude information of the current position coordinate of the target from the second GPS receiver and retrieves the digital map to extract altitude information of the current position coordinate of the target, so that three-dimensional position coordinate $P(x_p, y_p, z_p)$ of the target is obtained (Step 630). In the case where the target is an aircraft, the altitude is read from an altimeter built in a navigation system of the aircraft, or the altitude is read from a separately-installed altimeter. Next, the second control unit detects firing weapon identification information, a measured value of a leading angle, and' firing weapon position information from the received firing information, reads a trajectory equation corresponding to the firing weapon identification information from a memory, and completes the trajectory equation by inserting values of necessary variables such as a measured value of a leading angle and firing weapon position information (Step 640).

Hereinafter, the trajectory equation will be described in brief. The trajectory equation is an equation expressing a position of a bullet with respect to a time in the state where the bullet emitted from a firing weapon flies. If it is assumed that the flying bullet is influenced by only gravity, the trajectory equation becomes $x(t)=(\upsilon_0 \cos \theta_0)t$ and $$y(t) = v_o \sin\theta_o - \frac{1}{2}gt^2.$$

Herein, x(t) denotes a horizontal coordinate of the bullet in the flying direction at the time t after the firing; y(t) denotes a vertical coordinate of the bullet at the time t after the firing; $\upsilon_0$ denotes an initial velocity at the gun opening; and $\theta_0$ denotes an elevation angle of the gun barrel.

In an actual case, since the flying bullet is influenced by air resistance as well as gravity, the trajectory equation cannot be expressed in a closed form. Therefore, generally, the trajectory equation is generated in a form of a table, and the table is called a ballistics table or a firing table. The trajectory and the change of speed of the projectile can be visually checked with reference to the ballistics table. In the ballistics table, firing specifications including characteristics of the projectile and environmental conditions are listed. As detailed firing specifications, a type of a projectile, an initial velocity at a gun opening, a weight of the projectile, a drag coefficient, a temperature of atmosphere, a specific gravity or density of air, a temperature of powder, and the like are included. On the other hand, as items of the ballistics table, a range that is a distance of a straight line from the weapon and the projectile, superelevation, a horizontal coordinate of vertex, an altitude of vertex, a terminal velocity, a falling velocity, and the like are included.

Next, the equation of motion of the target is checked, and necessary variables are inserted, so that the equation of motion of the target is completed (Step 645). Next, a solution is obtained from the checked trajectory equation and the equation of motion of the target as simultaneous equations, and in this case, the solution is preferably obtained through an iterative method of numerical analysis (Step 650). As a result of the numerical analysis, if a difference value between the bullet position S(x, y, z) and the target position P(x, y, z) is equal to or less than a predefined boundary range value, it is determined that the target is hit. If the difference value is larger than the predefined boundary range value, it is determined that the target is not hit (Step 660). If it is determined that the target is not hit as a result of the firing result, an aiming error amount is calculated (Step 670).

Next, if the state value of the firing switch of the received firing information is ON (Step 680), the second control unit generates firing result information and allows the second radio signal transceiver to transmit the firing result information to the laser firing apparatus (Step 690).

The firing result information includes the firing weapon identification information, the information as to whether or not the target is hit, and the aiming error amount. If the state value of the firing switch of the received firing information is OFF, Steps 600 to 670 are repetitively performed to determine through numerical analysis whether or not the target is hit.

Hereinafter, processes of calculating the trajectory equation, the target equation of motion, the aiming error amount which are performed by the second control unit of the target sensing apparatus will be described in detail. A vector $\overrightarrow{OP}$ directing from the current position $O(x_0, y_0, z_0)$ of the firing weapon to the current position $P(x_p, y_p, z_p)$ of the target can be expressed by Equation 1.

$$\overrightarrow{OP}=(x_p-x_o y_P-y_o z_p-z_o) \quad \text{[Equation 1]}$$

The magnitude $r_P$ of the vector $\overrightarrow{OP}$ can be expressed by Equation 2.

$$r_p=|\overrightarrow{OP}|=\sqrt{(x_p-x_o)^2+(y_p-y_o)^2+(z_p-z_o)^2} \quad \text{[Equation 2]}$$

The azimuthal component of the vector $\overrightarrow{OP}$ can be expressed by Equation 3.

$$\phi_P = tan^{-1}\left(\frac{y_p - y_o}{x_p - x_o}\right) \quad \text{[Equation 3]}$$

When a plane is set as an elevation angle reference, the elevation angle component of the vector $\overrightarrow{OP}$ can be expressed by Equation 4.

$$\theta_P = tan^{-1}\left(\frac{z_p - z_o}{\sqrt{(x_p - x_o)^2 + (y_p - y_o)^2}}\right) \quad \text{[Equation 4]}$$

In addition, when the azimuthal component and the elevation angle component of the measured value of the leading angle are denoted by $\phi_L$ and $\theta_L$, respectively, the azimuthal component of the orientation of the gun barrel of the firing weapon becomes $\phi_B=\phi_P+\phi_L$, and the elevation angle component $\theta_B'$ of the orientation of the gun barrel of the firing weapon becomes $\theta_B'=\theta_P+\theta_L$.

In other words, the orientation of the gun barrel of the firing weapon is expressed by the vector $\overrightarrow{OB}$, which can be obtained by rotating the vector $\overrightarrow{OP}$ by $\theta_L$ in the azimuthal direction and by $\phi_L$ in the elevational direction. In general, in a spherical coordinate system, by considering that the z axis is set as the elevation angle reference, the vector $\overrightarrow{OB}$ is expressed by $\overrightarrow{OB}=(\tau_P\theta_B\phi_B)=(\tau_P 90°-\theta_B',\phi_B)$. In a rectangular coordinate system, the vector is expressed by Equation 5.

$$\overrightarrow{OB}=(x,y,z)=(\tau_P \sin\theta_B \cos\theta_B \tau_p \sin\phi_B \tau_p \cos\theta_B) \quad \text{[Equation 5]}$$

The position S(x(t), y(t), z(t)) of the projectile at a time t after the firing time of the firing weapon can be expressed by a trajectory equation. The trajectory equation is a function determined by initial conditions of the position coordinate $O(x_0, y_0, z_o)$ of the firing weapon, the orientation $\overrightarrow{OB}$ of the gun barrel, the initial speed $v_0$ of the projectile at the gun opening, and the like and environmental conditions of the wind direction and wind speed $\vec{W}$, the density of air $\rho_{air}$, and the like. The trajectory equation is expressed by Equation 6.

$$S(x,y,z)=F[O(x_0,y_0,z_0), \overrightarrow{OB}\upsilon_0, \vec{W}, \rho_{air}, t] \quad \text{[Equation 6]}$$

The trajectory equation is a function which is differently defined according to types of the firing weapons.

On the other hand, in the embodiment, it is assumed that the target moves at a constant speed, and if a position of the target received by the GPS receiver at a time t is denoted by P[x(t), y(t), z(t)], a velocity vector $\vec{\upsilon}_\tau$ of the target is obtained from a change rate of the position of the target. In other words, if a position of the target at a time t=0 is denoted by $P_0$[x(0), y(0), z(0)] and a position of the target at a time t=t1 is denoted by $P_l$[x(t1), y(t1), z(t1)], the velocity vector can be obtained by using Equation 7.

$$\vec{v_T} = \frac{\Delta P}{\Delta t} = \frac{P_1 - P_0}{t_1 - 0} = \left(\frac{x(t_1) - x(0)}{t_1 - 0}, \frac{y(t_1) - y(0)}{t_1 - 0}, \frac{z(t_1) - z(0)}{t_1 - 0}\right) \quad \text{[Equation 7]}$$

If the velocity vector is obtained as described above, an expected position P[x(t), y(t), z(t)] of a target at an arbitrary time t can be estimated by using Equation 8.

$$P[x(t),y(t),z(t)]=P_B(x(0),y(0),z(0))+\vec{v_G}\cdot t \quad \text{[Equation 8]}$$

Equation 8 is referred to as an equation of motion of a target.

The second control unit obtains a solution of simultaneous equations of the trajectory equation and the equation of motion of the target to determine whether or not the target is hit. There are various methods of solving the simultaneous equations. In general, in many cases, the trajectory equation is a non-linear function. In these cases, an iterative method of numerical analysis is used for its convenience. As the calculation is repeated according to the iterative method, if a difference value between the bullet position S(x(t), y(t), z(t)) and the target position P[x(t), y(t), z(t)] is decreased to converge to (0, 0, 0), it is determined that the solution is considered to exist. At this time, it is determined as a firing result that the target is hit. In this case, when the difference value is decreased to be equal to or less than a predetermined value, the calculation is stopped. As the calculation is repeated according to the iterative method, if the difference value between the bullet position S(x(t), y(t), z(t)) and the target position P[x(t), y(t), z(t)] is not decreased to be equal to or less than a predetermined threshold value but it is increased, it is determined that the solution is considered not to exist. At this time, it is determined as a firing result that the target is not hit.

Figure 7:
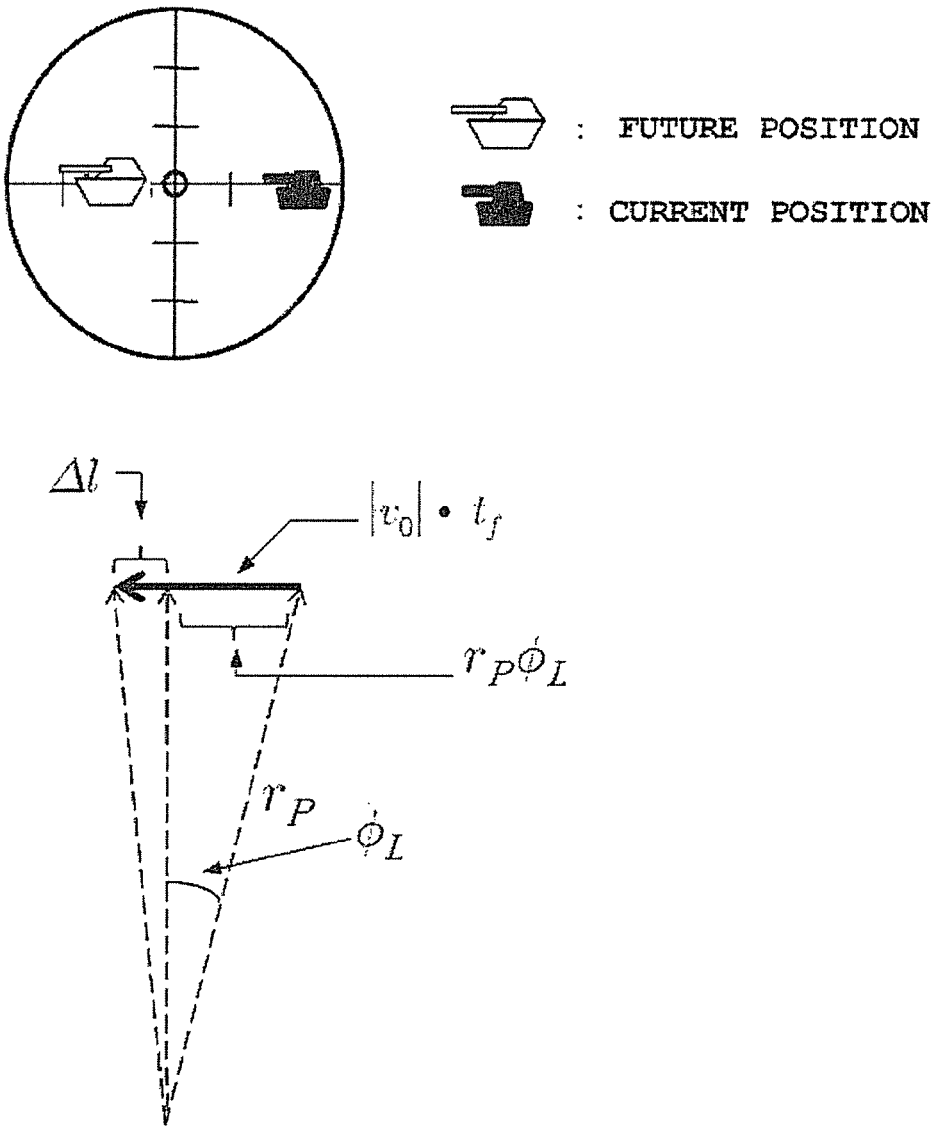
FIG. 7 is a diagram for explaining an aiming error amount in the case where a leading angle is aimed with a small angle by the second control unit of the target sensing apparatus of the firing weapon simulation system according to the preferred embodiment of the present invention.
Figure 8:
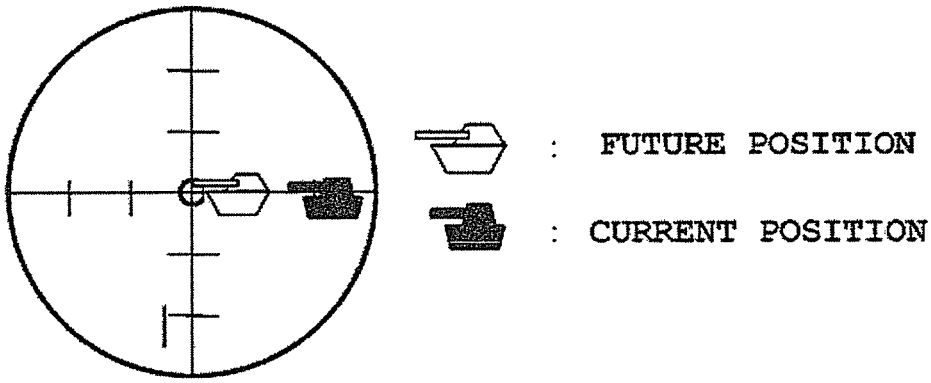
FIG. 8 is a diagram for explaining an aiming error amount in the case where a leading angle is aimed with a large angle.
Figure 8:
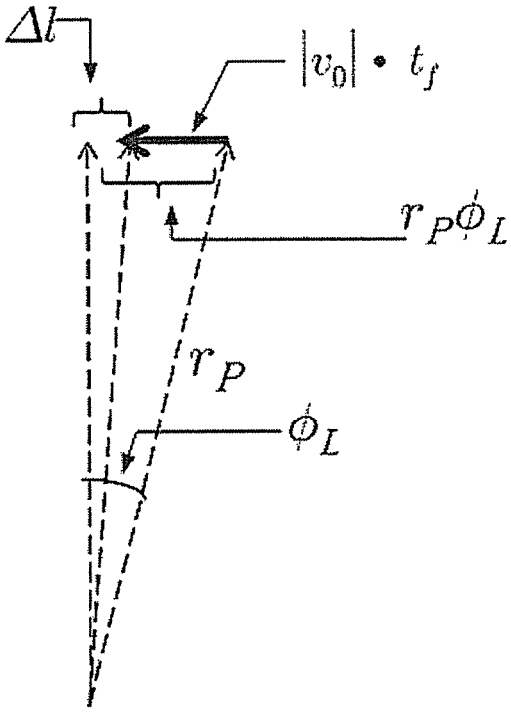

If it is determined as a firing result that the target is hit, the second control unit 500 drives the hitting situation indicator 570 to blink the warning lamp or to operate the speaker and allows the second radio signal transceiver 550 to transmit the hitting result information including the firing weapon identification information and the hitting information to the laser firing apparatus. If it is determined as a firing result that the target is not hit, the second control unit calculates the aiming error amount and allows the second radio signal transceiver to transmit the hitting result information including the firing weapon identification information and the aiming error information to the laser firing apparatus. Hereinafter, a process of calculating an aiming error amount performed by the second control unit of the target sensing apparatus will be described with reference to FIGS. 7 and 8. FIG. 7 is a diagram for explaining an aiming error amount in the case where a leading angle is aimed with a small angle by the second control unit of the target sensing apparatus of the firing weapon simulation system according to the preferred embodiment of the present invention. FIG. 8 is a diagram for explaining an aiming error amount in the case where a leading angle is aimed with a large angle.

In the embodiment, for simplifying the calculation of the aiming error amount, it is assumed that the target is transversely moving from the right side to the left side in the direction perpendicular to the vector. If the target is not hit as a firing result, the deviated amount can be approximately calculated as follows. The distance between the firing weapon position coordinate O($x_0$, $y_0$, $z_0$) and the bullet position coordinate S(x, y, z) can be expressed by Equation 9.

$$\overrightarrow{OS}=\sqrt{(x-x_0)^2+(y-y_0)^2+(z-z_0)^2} \quad \text{[Equation 9]}$$

The time $t=t_f$ when $\overrightarrow{OS}$ becomes equal to the magnitude $r_P$ of the vector $\overrightarrow{OP}$ obtained by using Equation 2 is obtained. Herein, $r_P$ is a distance between the target and the firing weapon when the trigger is pulled, that is, t=0. The moving distance of the target from the time t=0 to the time $t=t_f$ is $|\vec{v_0}|\cdot t_f$ which is obtained from the equation of motion of the target. The deviated distance Δ l in the azimuthal direction which is the horizontal direction can be obtained by using Equation 10.

$$\Delta l=|\vec{v_0}|\cdot t_f-\tau_P\phi_L \quad \text{[Equation 10]}$$

The azimuthally deviated angle Δϕ can be obtained by using Equation 11.

$$\Delta\phi \simeq \frac{|\vec{v_0}|\cdot t_f}{r_P} - \phi_L \quad \text{[Equation 11]}$$

If the value of Equation 10 and the value of Equation 11 are positive, as illustrated in FIG. 7, it is the case where the shooter sets a small leading angle, and thus, the bullet passes through a rear surface of the target which is transversely moving leftward. If the value of Equation 10 and the value of Equation 11 are negative, as illustrated in FIG. 8, it is the case where the shooter sets a large leading angle, and thus, the bullet passes through a front surface of the target which is transversely moving.

As a result of the firing, in the case where it is determined that the target is not hit, the second control unit allows the second radio signal transceiver to transmit aiming error information including information on the deviated distance and the deviated angle, and the first control unit of the laser firing apparatus diagrammatically display the aiming error information on a display, so that the shooter who views the aiming error information can perform corrected firing.

INDUSTRIAL APPLICABILITY

A firing weapon simulation system according to the present invention can be widely used to MIES as a system capable of training leading firing on moving targets.

The invention claimed is:

1. A laser firing apparatus mounted on a firing weapon to simulate leading firing with respect to a moving target by using a laser beam, comprising:

a control unit which controls whole operations of the laser firing apparatus;

a firing switch which is driven cooperatively with firing of the firing weapon;

an image processing unit which measures a leading angle from an image including the moving target aimed with the leading angle set through a sighting scope of the firing weapon;

a GPS receiver which provides a current position coordinate:

a laser beam firer which is mounted on the firing weapon to emit a laser beam carrying firing data according to a laser driving signal supplied from the control unit; and a motor assembly which rotates the laser beam firer according to a motor driving signal supplied from the control unit, wherein the image processing unit detects a beacon signal from the image including the moving target, recognizes accurately the moving target by using the detected beacon signal, and measures the leading angle by using a distance between the recognized moving target and a center of the image, and wherein, when the firing switch is switched on, the control unit generates the firing data, allows the motor assembly to reversely rotate the laser beam firer by a measured value of the leading angle, and allows the laser beam firer to emit the laser beam carrying the firing data.

2. The laser firing apparatus according to claim 1, further comprising an image capturing apparatus, wherein the image capturing apparatus captures the image including the moving target aimed with the leading angle set through the sighting scope of the firing weapon and supplies the captured image to the image processing unit, and wherein a center of a display screen of the image capturing apparatus is disposed to be coincident with a center of a crosshair of the sighting scope of the firing weapon.

3. The laser firing apparatus according to claim 1, wherein the image processing unit receives the image of the target aimed through the sighting scope of the firing weapon.

4. The laser firing apparatus according to claim 1, further comprising a radio signal transceiver which communicates data with a target sensing apparatus, wherein the control unit receives hitting result information from the target sensing apparatus through the radio signal transceiver and outputs the hitting result information through a display apparatus.

5. The laser firing apparatus according to claim 1, wherein the leading angle measured by the image processing unit includes a leading angle as an azimuthal angle and a leading angle as an elevation angle.

6. The laser firing apparatus according to claim 1, wherein when a trigger of the firing weapon is pulled, the firing switch connected to the trigger is switched on, or when vibration or explosion sound occurring according to firing of the firing weapon is sensed and a result of the sensing exceeds a predefined threshold value, the firing switch is switched on.

7. The laser firing apparatus according to claim 1, wherein the firing data includes the measured value of the leading angle input from the image processing unit, the current position coordinate input from the GPS receiver; and firing weapon identification information read from a memory.

8. The laser firing apparatus according to claim 1, wherein, when the firing switch is switched on, the control unit sets a state value of the firing switch to ON, and the firing data includes the measured value of the leading angle input from the image processing unit, the current position coordinate input from the GPS receiver;

firing weapon identification information read from a memory; and the state value of the firing switch.

9. The laser firing apparatus according to claim 8, further comprising a starting switch, wherein, when the starting switch is switched on, the image processing unit and the control unit are driven, and wherein, when the starting switch is switched on, the control unit allows the laser beam firer to emit the laser beam carrying the firing data until the firing switch is switched on.

10. A target sensing apparatus mounted on a target for simulating leading firing by using a laser beam, comprising:

a control unit which controls whole operations of the target sensing apparatus;

a sensing circuit unit which includes a plurality of laser sensors and extracts firing data from the laser beam received from the laser sensors;

a GPS receiver which is mounted on the target and provides a current position coordinate of the target; and a hitting situation indicator which indicates hitting result according to a driving signal transmitted from the control unit; and a beacon signal output unit which outputs a beacon signal according to a predefined pattern, wherein the control unit obtains a trajectory equation of each firing weapon from database, and if the firing data are received from the sensing circuit unit, the control unit reads firing weapon identification information, a measured value of a leading angle, and a current position of the firing weapon from the firing data, reads a trajectory equation corresponding to the firing weapon identification information from the database, and sets a trajectory equation by inserting the measured value of the leading angle and the current position of the firing weapon into the read trajectory equation, and wherein the control unit sets an equation of motion of the target by using a current position value of the target and a velocity of the target transmitted from the GPS receiver, solves simultaneous equations of the trajectory equation and the equation of motion of the target to determine whether or not the target is hit, and outputs a result of the determination to the hitting situation indicator.

11. The target sensing apparatus according to claim 10, wherein the sensing circuit unit includes: a sensing unit which is configured to include a plurality of the laser sensors; an amplifier which amplifies signals transmitted from the sensing unit; and a decoder which decodes signals transmitted from the amplifier to extract the firing data.

12. The target sensing apparatus according to claim 10, wherein the control unit determines whether or not a difference value between a bullet position obtained by using the trajectory equation and a target position obtained by using the equation of motion of the target is included within a predefined threshold range, and wherein, if the difference value is included within the threshold range, the control unit determines that the target is hit; and if the difference value is not decreased to be equal to or less than the threshold value, the control unit determines that the target is not hit.

13. The target sensing apparatus according to claim 10, wherein the hitting situation indicator is configured with one or more of a warning lamp, a speaker, a display apparatus, and a vibration apparatus.

14. The target sensing apparatus according to claim 10, wherein the target sensing apparatus further includes a radio signal transceiver which can communicate data with the laser firing apparatus, and wherein the control unit generates hitting result information including hitting information, aiming error information, and firing weapon identification information according to determination whether or not the target is hit and transmits the hitting result information through the radio signal transceiver to the laser firing apparatus.

15. A firing weapon simulation system simulating leading firing by using a laser firing apparatus mounted on a firing weapon and a target sensing apparatus attached to a moving target, wherein the laser firing apparatus includes:

a first control unit which controls whole operations of the laser firing apparatus;

a firing switch which is driven cooperatively with firing of the firing weapon;

an image processing unit which measures a leading angle from an image including the moving target aimed with the leading angle set through a sighting scope of the firing weapon;

a first GPS receiver which provides a current position coordinate:

a laser beam firer which is mounted on the firing weapon to emit a laser beam carrying firing data according to a laser driving signal supplied from the first control unit; and a motor assembly which rotates the laser beam firer according to a motor driving signal supplied from the first control unit, wherein, when the firing switch is switched on, the first control unit generates the firing data, allows the motor assembly to reversely rotate the laser beam firer by a measured value of the leading angle, and allows the laser beam firer to emit the laser beam carrying the firing data, wherein the image processing unit of the laser firing apparatus detects a beacon signal from an image including the moving target, recognizes accurately the moving target by using the detected beacon signal, and measures the leading angle by using a distance between the recognized moving target and the center of the image, wherein the target sensing apparatus includes:

a second control unit which controls whole operations of the target sensing apparatus;

a sensing circuit unit which includes a plurality of laser sensors and extracts firing data from the laser beam received from the laser sensors;

a second GPS receiver which is mounted on the target and provides a current position coordinate of the target;

a hitting situation indicator which indicates hitting result according to a driving signal transmitted from the second control unit; and a beacon signal output unit which outputs a beacon signal according to a predefined pattern, wherein the second control unit obtain a trajectory equation of each firing weapon from database, and if the firing data are received from the sensing circuit unit, the second control unit reads firing weapon identification information, a measured value of a leading angle, and a current position of the firing weapon from the firing data, reads a trajectory equation corresponding to the firing weapon identification information from the database, and sets a trajectory equation by inserting the measured value of the leading angle and the current position of the firing weapon into the read trajectory equation, and wherein the second control unit sets an equation of motion of the target by using a current position value of the target and a velocity of the target transmitted from the second GPS receiver, solves simultaneous equations of the trajectory equation and the equation of motion of the target to determine whether or not the target is hit, and outputs a result of the determination to the hitting situation indicator.

16. The firing weapon simulation system according to claim 15, wherein the laser firing apparatus further includes a first radio signal transceiver which can communicate data with the target sensing apparatus, and wherein the target sensing apparatus further includes a second radio signal transceiver which can communicate data with the laser firing apparatus, and the second control unit of the target sensing apparatus generates hitting result information and transmits the hitting result information through the second radio signal transceiver to the laser firing apparatus.

* * * * *